US010379468B2

(12) United States Patent
Nozawa et al.

(10) Patent No.: US 10,379,468 B2
(45) Date of Patent: Aug. 13, 2019

(54) HEATING UNIT AND IMAGE FORMING APPARATUS

(71) Applicant: FUJI XEROX CO., LTD., Tokyo (JP)

(72) Inventors: Narumi Nozawa, Kanagawa (JP); Kazuaki Ilkura, Kanagawa (JP)

(73) Assignee: FUJI XEROX CO., LTD., Minato-Ku, Tokyo (JP)

( * ) Notice: Subject to any disclaimer, the term of this patent is extended or adjusted under 35 U.S.C. 154(b) by 0 days.

(21) Appl. No.: 15/916,338

(22) Filed: Mar. 9, 2018

(65) Prior Publication Data

US 2019/0011863 A1 Jan. 10, 2019

(30) Foreign Application Priority Data

Jul. 4, 2017 (JP) ..... 2017-131174

(51) Int. Cl.
*G03G 15/20* (2006.01)
*G03G 15/16* (2006.01)
*G03G 15/02* (2006.01)

(52) U.S. Cl.
CPC ..... *G03G 15/2053* (2013.01); *G03G 15/1665* (2013.01); *G03G 15/0216* (2013.01)

(58) Field of Classification Search
USPC ..... 399/107, 110, 122, 320, 328–331; 219/216, 619
See application file for complete search history.

(56) References Cited

U.S. PATENT DOCUMENTS 7,522,861 B2 * 4/2009 Yano ..... G03G 21/20 399/122
8,644,716 B2 * 2/2014 Ogawahara ..... G03G 15/2064 399/12

FOREIGN PATENT DOCUMENTS

JP 2005-091522 A 4/2005
JP 2009-103759 A 5/2009

* cited by examiner

*Primary Examiner* — Hoan H Tran
(74) *Attorney, Agent, or Firm* — Sighrue Mion, PLLC

(57) ABSTRACT

A heating unit includes a first rotatable member that generates heat; a second rotatable member that forms, in combination with the first rotatable member, a nip area through which sheets of different sizes pass one by one; a housing that supports the first and second rotatable members such that the first and second rotatable members are rotatable; an electronic component that is fixed to the housing and includes a portion that overlaps a smallest one of the sheets passing through the nip area in terms of a position in a long-side direction of the nip area; and an other member that is provided between the first rotatable member and the electronic component.

12 Claims, 6 Drawing Sheets

HEATING UNIT AND IMAGE FORMING APPARATUS

CROSS-REFERENCE TO RELATED APPLICATIONS

This application is based on and claims priority under 35 USC 119 from Japanese Patent Application No. 2017-131174 filed Jul. 4, 2017.

BACKGROUND

Technical Field

The present invention relates to a heating unit and an image forming apparatus.

SUMMARY

According to an aspect of the invention, there is provided a heating unit including a first rotatable member that generates heat; a second rotatable member that forms, in combination with the first rotatable member, a nip area through which sheets of different sizes pass one by one; a housing that supports the first and second rotatable members such that the first and second rotatable members are rotatable; an electronic component that is fixed to the housing and includes a portion that overlaps a smallest one of the sheets passing through the nip area in terms of a position in a long-side direction of the nip area; and an other member that is provided between the first rotatable member and the electronic component.

BRIEF DESCRIPTION OF THE DRAWINGS

An exemplary embodiment of the present invention will be described in detail based on the following figures, wherein.

DETAILED DESCRIPTION

[1] Exemplary Embodiment

Figure 1:
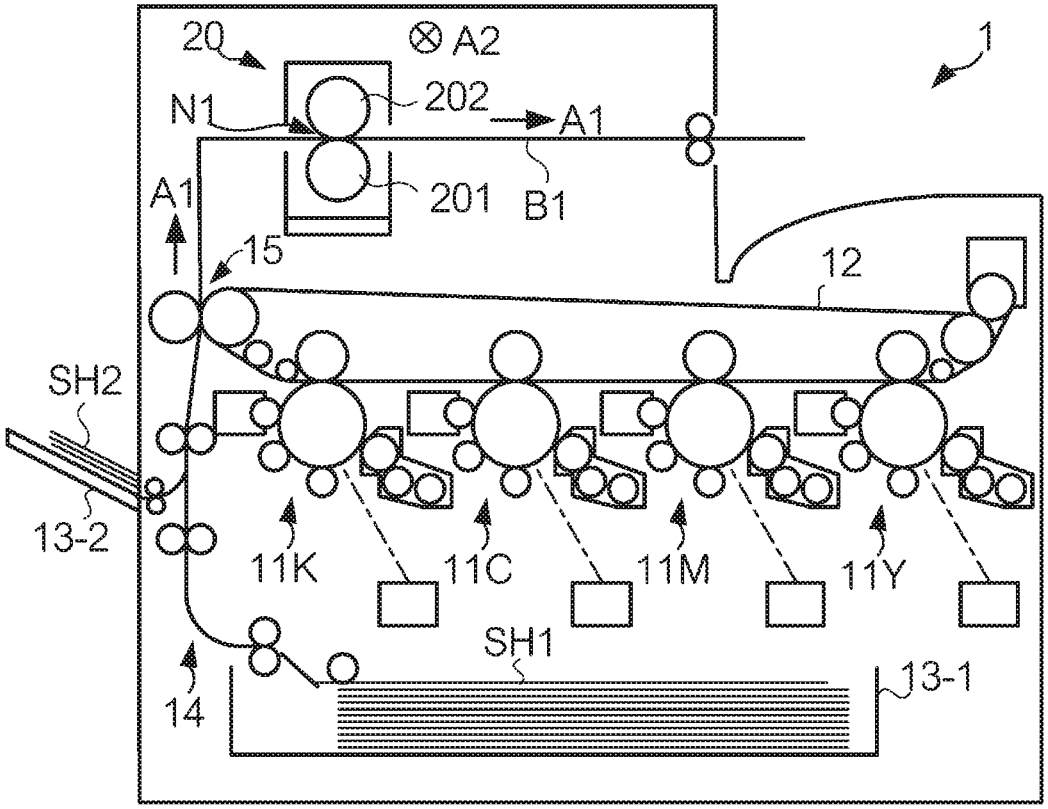
FIG. 1 illustrates an overall configuration of an image forming apparatus according to an exemplary embodiment.

FIG. 1 illustrates an overall configuration of an image forming apparatus 1 according to an exemplary embodiment. The image forming apparatus 1 electrophotographically forms a color image on a medium. The image forming apparatus 1 is connected to an external apparatus with a communication line (not illustrated). When image data is transmitted to the image forming apparatus 1 from the external apparatus, the image forming apparatus 1 converts the image data of, for example, an RGB color scheme into image data of a CMYK color scheme. In accordance with the converted image data, the image forming apparatus 1 forms a color image on a medium by fixing four kinds of toners having respective colors of yellow (Y), magenta (M), cyan (C), and black (K) and provided on the medium.

The image forming apparatus 1 includes toner-image-transferring devices 11 (11Y, 11M, 11C, and 11K), an intermediate transfer belt 12, sheet-feeding devices 13 (13-1 and 13-2), a transport device 14, a second transfer device 15, and a fixing device 20. The toner-image-transferring devices 11 for the respective colors of Y, M, C, and K are arranged along the intermediate transfer belt 12 and, in combination, form an image based on the image data by transferring toner images in the respective colors to the intermediate transfer belt 12 one on top of another. The intermediate transfer belt 12 is an endless belt and carries the image formed by the toner-image-transferring devices 11.

The sheet-feeding devices 13 contain sheets of respective sizes, such as postcards and pieces of printing paper, and feed the sheets one by one to the transport device 14. The sheet-feeding device 13-1 is provided on the inside of the image forming apparatus 1 and feeds sheets SH1, which are of a regular size such as a size A4 or B4. The sheet-feeding device 13-2 is provided on the outside of the image forming apparatus 1 and feeds sheets SH2 of a large size or a small size that are not feedable from the sheet-feeding device 13-1, as well as pieces of printing paper of a regular size. Sheets that are of the smallest size feedable by the image forming apparatus 1 are postcards.

The transport device 14 includes plural rollers and transports each of the sheets, fed from either of the sheet-feeding devices 13, in a transport direction A1 along a transport path B1. The sheet transported by the transport device 14 passes through the second transfer device 15 and the fixing device 20 in that order. The second transfer device 15 includes a transfer roller and a backup roller. The transfer roller and the backup roller are provided face to face with the intermediate transfer belt 12 and the transport path B1 in between. A transfer voltage is applied to the nip between the transfer roller and the backup roller. Thus, the second transfer device 15 transfers the image carried by the intermediate transfer belt 12 to the sheet transported thereto by the transport device 14. The image transferred to the sheet is fixed by the fixing device 20, and the sheet having the fixed image is discharged to the outside of the image forming apparatus 1 by the transport device 14.

The fixing device 20 applies heat and pressure to the sheet having the transferred image, thereby fixing the image. The fixing device 20 is a unit that is attachable to and detachable from the body of the image forming apparatus 1. The fixing device 20 is an example of "heating unit" according to the present invention. The fixing device 20 includes a heating roller 201 and a pressure roller 202 that are rotatable about the respective axes of rotation.

Referring to FIG. 1, a direction in which the axes of rotation of the two rollers extend and that heads from the near side toward the far side is denoted as a rotational-axis direction A2. FIG. 1 illustrates the fixing device 20 that is seen in the rotational-axis direction A2. The heating roller 201 is a rotatable member that generates heat and is an example of "first rotatable member" according to the present invention. The pressure roller 202 extends with the axis of rotation thereof being parallel to the axis of rotation of the heating roller 201.

The pressure roller 202 is a rotatable member that is pressed against the heating roller 201. The pressure roller 202 and the heating roller 201 in combination form a nip area N1 through which the sheet passes. The pressure roller 202 is an example of "second rotatable member" according to the present invention. The nip area N1 forms a part of the transport path B1. The sheet is transported along the transport path B1, including the nip area N1, to the fixing device 20. The sheet thus transported has an image formed by the toner-image-transferring devices 11, the intermediate transfer belt 12, and the second transfer device 15.

The toner-image-transferring devices 11, the intermediate transfer belt 12, and the second transfer device 15 that in combination form the image on the sheet while the sheet is transported on the upstream side with respect to the nip area N1 are grouped as an example of "image forming device" according to the present invention. The sheet passing through the nip area N1 receives the heat generated by the heating roller 201 and the pressure generated by the combination of the heating roller 201 and the pressure roller 202. Thus, the fixing device 20 fixes the image, transferred to the sheet by the second transfer device 15, on the sheet.

Figure 2:
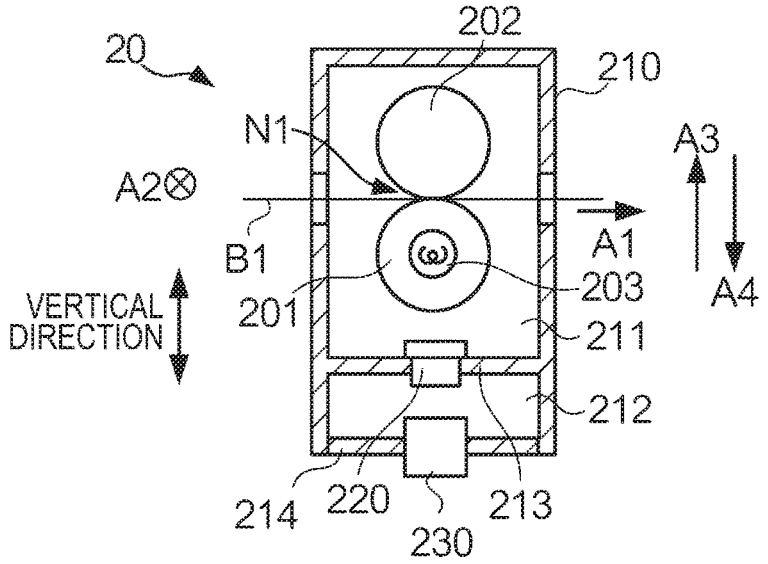
FIG. 2 is an enlarged view of a fixing device.

FIG. 2 is an enlarged view of the fixing device 20. The fixing device 20 includes a housing 210 that houses the heating roller 201 and the pressure roller 202. The heating roller 201 and the pressure roller 202 are rotatably supported by the housing 210. The heating roller 201 and the pressure roller 202 according to the present exemplary embodiment are stacked one on top of the other in the vertical direction, with the heating roller 201 positioned on the vertically lower side. In FIG. 2, a direction from the heating roller 201 toward the pressure roller 202 is denoted as a first stacking direction A3, and a direction from the pressure roller 202 toward the heating roller 201 is denoted as a second stacking direction A4. The first stacking direction A3 and the second stacking direction A4 are both parallel to the vertical direction.

The housing 210 has a first housing space 211 in which the heating roller 201 and the pressure roller 202 are provided, and a second housing space 212 provided on the arrow-head side of the first housing space 211 in the second stacking direction A4. The sidewalls of the first housing space 211 that are on the upstream side and the downstream side with respect to the nip area N1 has openings, respectively, at positions through which the transport path B1 extends. The first housing space 211 and the second housing space 212 are separated from each other by an inner wall 213. The inner wall 213 has a hole in which a heat sensor 220 is fitted.

The heat sensor 220 measures the temperature of the outer peripheral surface of the heating roller 201 and is provided in such a manner as to face the heating roller 201 in the housing 210. The heat sensor 220 is an example of "sensor" according to the present invention. The heating roller 201 includes a halogen lamp 203 built therein as a heat source. The heat sensor 220 and the halogen lamp 203 are provided with wiring lines (not illustrated in FIG. 2), respectively. The wiring lines are connected to a connector 230.

The wiring lines run in the first housing space 211 and in the second housing space 212. The housing 210 includes a lid portion 214 provided on the arrow-head side of the second housing space 212 in the second stacking direction A4. When the lid portion 214 is opened, the wiring lines and the heat sensor 220 in the second housing space 212 are exposed, whereby, for example, an operator is allowed to work on the wiring lines and the heat sensor 220. The lid portion 214 has a hole in which the connector 230 is fitted.

The connector 230 is a component that bundles the wiring lines, through which power and signals are supplied to the heat sensor 220 and the halogen lamp 203 from the outside. The connector 230 is an example of "electronic component" according to the present invention. The connector 230 is fixed on the arrow-head side of the housing 210 in the second stacking direction A4 and is partially exposed to the outside of the housing 210. The exposed part of the connector 230 is fitted in a connector provided to the body of the image forming apparatus 1, whereby the wiring lines provided to the fixing device 20 are connected to wiring lines provided to the body of the image forming apparatus 1.

The connector 230 is positioned across the heating roller 201 from the pressure roller 202. That is, the connector 230, the heating roller 201, and the pressure roller 202 are aligned in the first stacking direction A3 or the second stacking direction A4. In the image forming apparatus 1, the heating roller 201 is positioned vertically below the pressure roller 202. Therefore, the connector 230 is provided so as not to be positioned vertically above the heating roller 201 in a state where the fixing device 20 is attached to a predetermined position, i.e., the body of the image forming apparatus 1 (in the present exemplary embodiment, the connector 230 is positioned vertically below the heating roller 201).

Members other than the connector 230, specifically, the inner wall 213 and the heat sensor 220, are positioned between the connector 230 and the heating roller 201. The inner wall 213 and the heat sensor 220 are each a member that is positioned between the electronic component (in the present exemplary embodiment, the connector 230) and the first rotatable member (in the present exemplary embodiment, the heating roller 201) and are each an example of "other member" according to the present invention. That is, the inner wall 213 and the heat sensor 220 are positioned on the arrow-head side of the heating roller 201 in the second stacking direction A4, and the connector 230 is positioned on the arrow-head side of the inner wall 213 and the heat sensor 220 in the second stacking direction A4.

In other words, the inner wall 213 and the heat sensor 220 are positioned on the arrow-head side with respect to the connector 230 in the first stacking direction A3, and the heating roller 201 is positioned on the arrow-head side with respect to the inner wall 213 and the heat sensor 220 in the first stacking direction A3. In such an arrangement of the inner wall 213 and the heat sensor 220, the heat radiated from the heating roller 201 does not directly reach the connector 230, and the heat transmission from the heating roller 201 to the connector 230 is less than in a case where the heat from the heating roller 201 directly reaches the connector 230.

Figure 3:
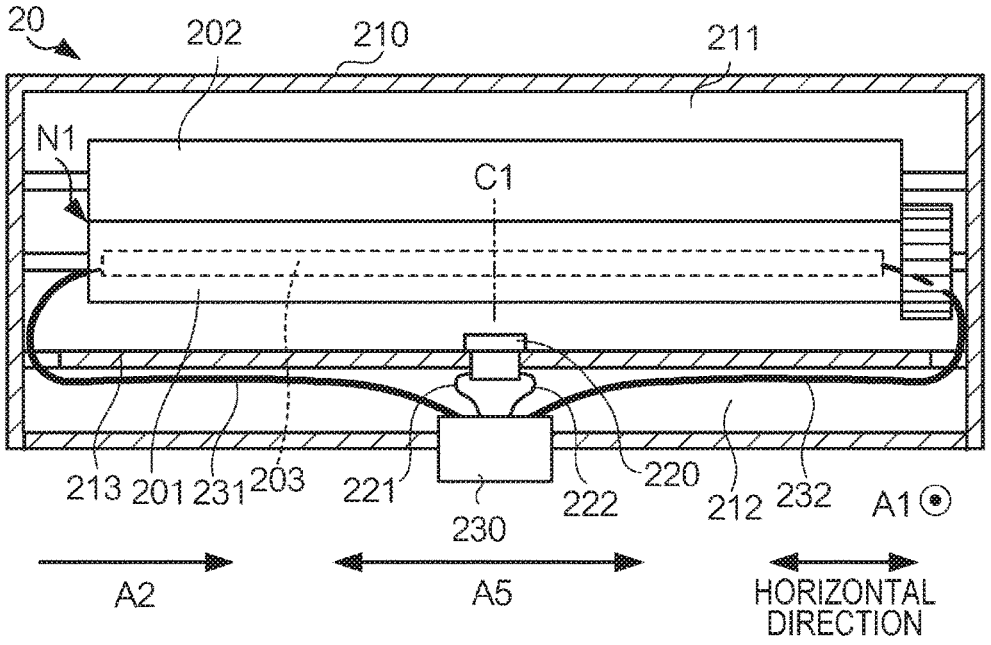
FIG. 3 illustrates the fixing device seen in a transport direction.

FIG. 3 illustrates the fixing device 20 seen in the transport direction A1. In FIG. 3, a long-side direction of the nip area N1 is denoted as A5. The nip area N1 has a length of, for example, about ten-odd centimeters (cm) to several tens of centimeters (cm) in the rotational-axis direction A2 and a length of about several millimeters (mm) in the transport direction A1. The long-side direction A5 corresponds to the rotational-axis direction A2. The long-side direction A5 also corresponds to the widthwise direction of the sheet passing through the nip area N1 in the transport direction A1 (i.e., a direction orthogonal to the transport direction A1). The heating roller 201 and the pressure roller 202 are arranged such that the axes of rotation thereof extend in the horizontal direction, normally. Therefore, the rotational-axis direction A2 and the long-side direction A5 also correspond to the horizontal direction.

A wiring line 221 and a wiring line 222 that connect the connector 230 and the heat sensor 220 to each other run in the second housing space 212. The inner wall 213 has holes at two ends thereof in the long-side direction A5. The connector 230 and the halogen lamp 203 are connected to each other with wiring lines 231 and 232, which run through the holes, respectively. In the present exemplary embodiment, the heat sensor 220 is provided at a position facing a center C1 of the heating roller 201 in the long-side direction A5. The position of the connector 230 in the long-side direction A5 is determined on the basis of which part of the nip area N1 the sheet passes (the area is hereinafter referred to as "passing area").

Figure 4:
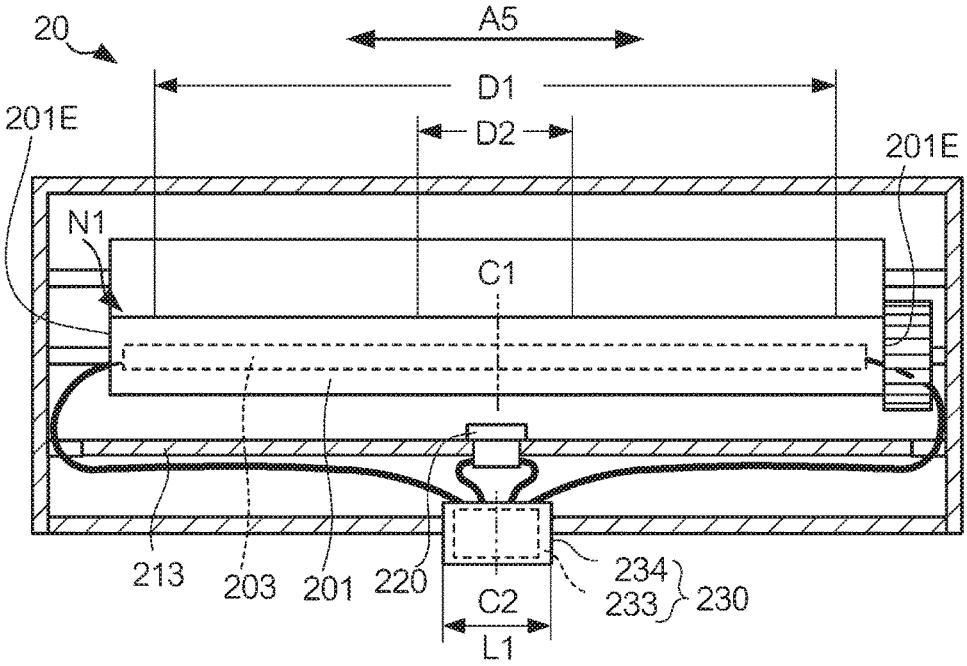
FIG. 4 illustrates passing areas for different sheets.

FIG. 4 illustrates passing areas for different sheets. The nip area N1 illustrated in FIG. 4 includes a passing area D1 for the sheet whose size in the long-side direction A5 is the largest among those of the sheets used in the image forming apparatus 1, and a passing area D2 for the sheet whose size in the long-side direction A5 is the smallest (the postcard size) among those of the sheets used in the image forming apparatus 1. The transport device 14 of the image forming apparatus 1 transports each sheet such that the centers of the passing areas D1 and D2 and the centers of passing areas for sheets of other sizes coincide with the center C1 of the heating roller 201 in terms of the position in the long-side direction A5.

The halogen lamp 203 is longer than the passing area D1 in the long-side direction A5. Hence, even the sheet of the largest size in the long-side direction A5 is allowed to receive heat from end to end thereof in the long-side direction A5. A length L1 of the connector 230 in the long-side direction A5 is shorter than the length of the passing area D1 in the long-side direction A5 and is shorter than the length of the passing area D2 in the long-side direction A5.

The connector 230 includes a circuit portion 233 formed of metal, a semiconductor, and so forth, and a covering portion 234 made of plastic or the like. The covering portion 234 covers the circuit portion 233. The covering portion 234 does not conduct electricity but is necessary for keeping the connector 230 fitted in the connector provided to the body of the image forming apparatus 1. Therefore, the connector 230 inclusive of the covering portion 234 is regarded as an electronic component. Accordingly, the size of the connector 230 refers to the size of the covering portion 234.

A center C2 of the connector 230 coincides with the center C1 of the heating roller 201 in terms of the position in the long-side direction A5. In other words, the connector 230 includes a portion (in the present exemplary embodiment, a portion at the center C2) that coincides with the center C1 of the heating roller 201 in terms of the position in the long-side direction A5. The passing areas D1 and D2 are also present at the center C1 in terms of the position in the long-side direction A5. Therefore, the connector 230 includes a portion that overlaps the passing areas D1 and D2 in terms of the position in the long-side direction A5.

In other words, there exists a virtual plane that is orthogonal to the long-side direction A5 and that intersects all of the connector 230 and the passing areas D1 and D2. Now, a case where there exists no such plane, that is, a fixing device according to a comparative embodiment in which the connector includes no portion that overlaps the passing areas D1 and D2 in terms of the position in the long-side direction A5, will be described with reference to FIG. 5.

Figure 5:
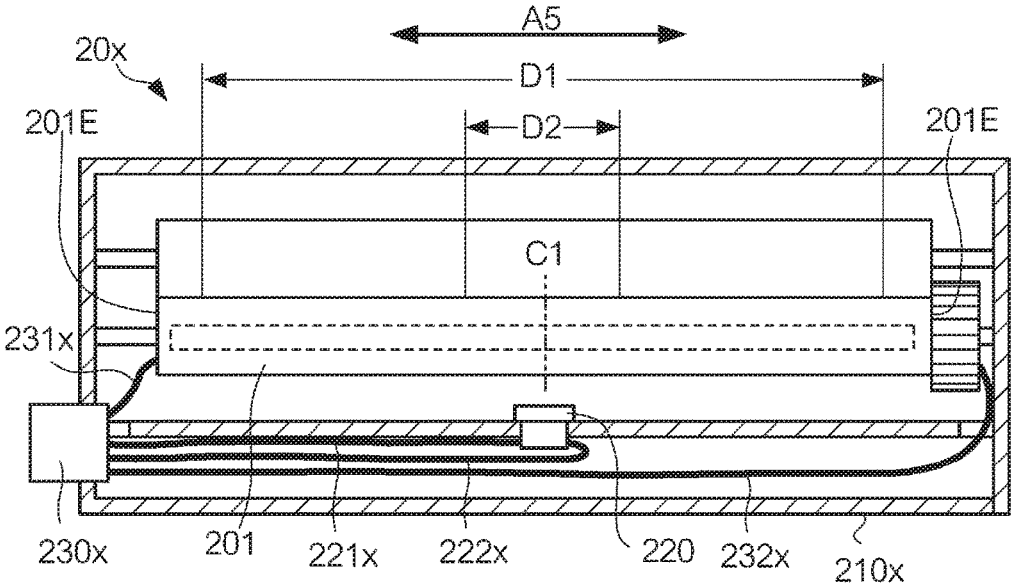
FIG. 5 illustrates a comparative fixing device seen in the transport direction.

FIG. 5 illustrates a comparative fixing device 20*x* seen in the transport direction A1. The fixing device 20*x* includes a connector 230*x* provided on the outer side with respect to an end of a heating roller 201E in the long-side direction A5. Therefore, the connector 230*x* does not overlap any portions of the passing areas D1 and D2 in terms of the position in the long-side direction A5, and there exists no virtual plane that intersects all of the connector 230*x* and the passing areas D1 and D2.

In contrast, in the present exemplary embodiment illustrated in FIG. 4, there exists the above virtual plane in every part of the connector 230 in the long-side direction A5. That is, the connector 230 overlaps the passing areas D1 and D2 at every position in the long-side direction A5. The passing area D1 is a portion of the nip area N1 where the sheet having the largest size in the long-side direction A5 passes. Therefore, the connector 230 also includes a portion that overlaps the largest one (the sheet having the largest size in the long-side direction A5) of the sheets that pass through the nip area N1 in terms of the position in the long-side direction A5.

The passing area D2 is a portion of the nip area N1 where the sheet having the smallest size in the long-side direction A5 passes. Therefore, the connector 230 also includes a portion that overlaps the smallest one (the sheet having the smallest size in the long-side direction A5) of the sheets that pass through the nip area N1 in terms of the position in the long-side direction A5. Furthermore, the connector 230 also includes a portion that overlaps the heat sensor 220 in terms of the position in the long-side direction A5.

If the heat generated by the heating roller 201 is transmitted to the electronic component (the connector 230 in the present exemplary embodiment), the electronic component may cause a malfunction. If the electronic component (the connector 230*x*) is provided on the outer side with respect to an end 201E of the heating roller 201 in the long-side direction A5 as with the comparative embodiment illustrated in FIG. 5, the distance between the electronic component and the heat source (the heating roller 201) becomes longer but the size of the fixing device 20 in the long-side direction A5 tends to become larger, as with the comparative embodiment illustrated in FIG. 5, than in the case where the electronic component is provided on the inner side with respect to the end 201E in the long-side direction A5. In the present exemplary embodiment, the connector 230 is provided on the inner side with respect to the end 201E in the long-side direction A5. Therefore, the size of the fixing device 20 in the long-side direction A5 is smaller than that of the fixing device 20*x* according to the comparative embodiment illustrated in FIG. 5.

When a sheet passes through the nip area N1, the heat generated by the heating roller 201 is used for fixing the image and for increasing the temperature of the sheet. Therefore, the temperature of the outer peripheral surface of the heating roller 201 in the passing area for that sheet becomes lower than in the other area. In the present exemplary embodiment, the connector 230 is provided at a position overlapping the passing areas D1 and D2, where the temperature is more likely to be reduced than in the other area when the sheet passes therethrough, in terms of the position in the long-side direction A5.

Hence, among all positions on the inner side with respect to the end 201E in the long-side direction A5, the connector 230 is provided at a position where the amount of heat transmission from the heating roller 201 is smaller than the other positions. Moreover, since the connector 230 and the passing area D2 overlap each other in terms of the position in the long-side direction A5, the amount of heat transmission from the heating roller 201 to the connector 230 is smaller than in a case where the two overlap each other, regardless of the size of the sheet that passes through the nip area N1.

In the present exemplary embodiment, the connector 230 includes a portion that is present at the center C1 of the heating roller 201 in terms of the position in the long-side direction A5. Hence, no matter how small the size of the sheet is, the sheet overlaps the connector 230 in terms of the position in the long-side direction A5 without fail. Accordingly, as described above, the amount of heat transmission from the heating roller 201 to the connector 230 is suppressed.

For example, if the connector 230 is on a side of the heating roller 201 where the pressure roller 202 is provided, the wiring lines connecting the connector 230 to the heat sensor 220 become longer than the wiring lines 221 and 222 illustrated in FIG. 3. As another example, if the connector 230 is provided at a position shifted with respect to the heating roller 201 and the pressure roller 202 in the transport direction A1, the size of the fixing device 20 in the transport direction A1 becomes larger than in the case illustrated in FIG. 2.

In the configuration according to the present exemplary embodiment illustrated in FIG. 2, the connector 230 is provided across the heating roller 201 from the pressure roller 202. Furthermore, the connector 230, the heating roller 201, and the pressure roller 202 are exactly aligned in the first stacking direction A3. Therefore, it is easier to make the wiring lines shorter and to reduce the size of the fixing device in the transport direction A1 than in the other configurations.

According to the present exemplary embodiment, in the state where the fixing device 20 is attached to the body of the image forming apparatus 1, the connector 230 is positioned vertically below the heating roller 201. Therefore, the amount of heat transmission from the heating roller 201 to the connector 230 is smaller than in the case where the connector 230 is positioned vertically above the heating roller 201.

According to the comparative embodiment illustrated in FIG. 5, the connector 230*x* includes no portion that overlaps the heat sensor 220 in terms of the position in the long-side direction A5, and the wiring lines 221*x* and 222*x* are longer by the distance between the connector 230*x* and the heat sensor 220 in the long-side direction A5 than in the present exemplary embodiment. In contrast, according to the present exemplary embodiment, since the connector 230 includes a portion that overlaps the heat sensor 220 in terms of the position in the long-side direction A5, the wiring lines 221 and 222 connecting the connector 230 and the heat sensor 220 are shorter than in the comparative embodiment illustrated in FIG. 5.

[2] Modifications

The above embodiment of the present invention is only exemplary and may be modified as follows. Note that the above exemplary embodiment and the following modifications may be combined according to need.

[2-1] Electronic Component

The electronic component included in the fixing device is not limited to the connector and may be any other component such as an automatic temperature-regulating circuit (a thermostat) that stops the supply of power to the halogen lamp 203 at an extreme increase in the temperature of the heating roller 201. In such a case also, as long as the electronic component is positioned as described in the above exemplary embodiment, the amount of heat transmission from the heating roller 201 is smaller than in a case where the electronic component is provided at a different position.

[2-2] Shape of Housing

The shape of the housing is not limited to that described in the above exemplary embodiment. For example, the housing may include only the first housing space 211 in which the heating roller 201 and the pressure roller 202 are provided, that is, the second housing space 212 may be omitted. In such a case, the electronic component and the wiring lines thereof are exposed on the outside of the fixing device.

[2-3] Method of Fixing Electronic Component to Housing

The method of fixing the electronic component to the housing may be different from that employed in the above exemplary embodiment.

Figure 6A:
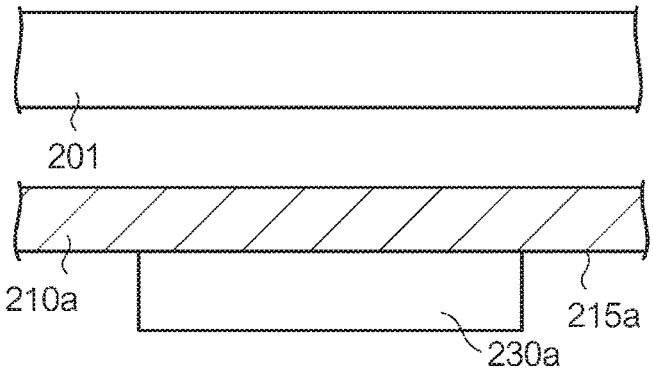
FIG. 6A illustrates an exemplary method of fixing an electronic component to a housing according to a modification.
Figure 6B:
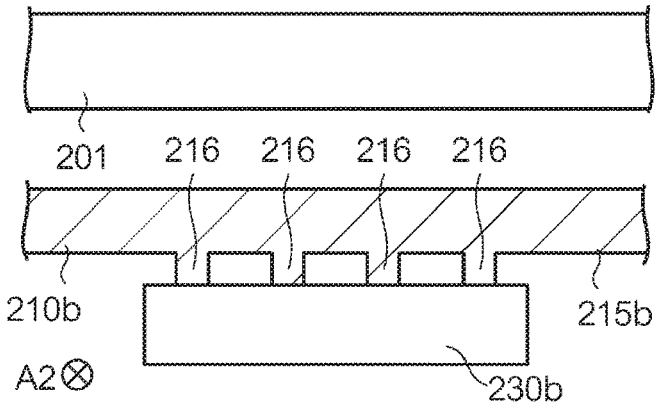
FIG. 6B illustrates an exemplary method of fixing an electronic component to a housing according to another modification.

FIGS. 6A and 6B each illustrate an exemplary method of fixing an electronic component 230*a* or 230*b* to a housing 210*a* or 210*b* according to a modification. In FIG. 6A, the electronic component 230*a* is attached to a flat surface 215*a* of the housing 210*a* that faces away from the heating roller 201.

In FIG. 6B, the housing 210*b* has ridges 216 on a surface 215*b* thereof that faces away from the heating roller 201, and the electronic component 230*b* is fixed to the ridges 216. More specifically, the ridges 216 are each a long narrow stick-like projection extending in the rotational-axis direction A2 and are arranged at intervals on part of the surface of the housing 210*b*.

The heat generated by the heating roller 201 is transmitted through the air and the housing 210*a* or 210*b* to the electronic component 230*a* or 230*b*. The housing 210*a* or 210*b* is made of plastic, resin, metal, or the like. Any of such materials has higher thermal conductivity than air. Therefore, in the configuration illustrated in FIG. 6B where the electronic component 230*b* is fixed to the ridges 216 of the housing 210*b*, the area of contact between the electronic component 230*b* and the housing 210*b* is smaller and the amount of heat transmitted to the electronic component 230*b* through the housing 210*b* is smaller than in the configuration illustrated in FIG. 6A where the electronic component 230*a* is fixed to the flat surface 215*a* of the housing 210*a*.

The shape of the ridges is not limited to that illustrated in FIG. 6. For example, the ridges may be any projections arranged at intervals and each having a shape of a round column, a quadrangular prism, a triangular prism, a hemisphere, or the like. Moreover, the ridges are not limited to those formed by providing projections on the surface of the housing and may be formed by providing depressions in the surface of the housing. In such a configuration also, the area of contact between the housing and the electronic component attached to the ridges of the housing is smaller and the amount of heat transmitted to the electronic component through the housing is therefore smaller than in the configuration in which the electronic component is fixed to a flat surface of the housing.

[2-4] Method of Fixing Electronic Component to Body of Image Forming Apparatus

The electronic component may be fixed to the body of the image forming apparatus, not to the housing.

Figure 7:
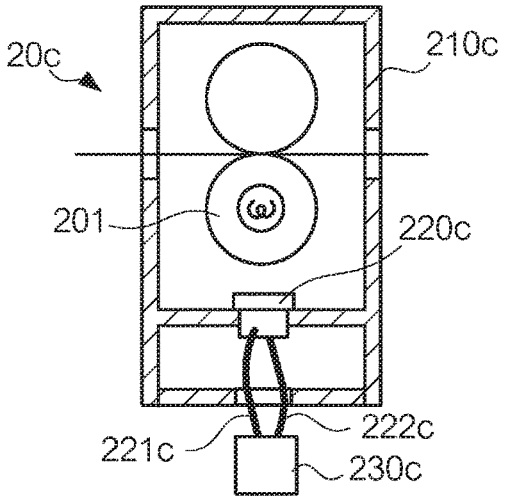
FIG. 7 illustrates a fixing device according to a modification.

FIG. 7 illustrates a fixing device 20*c* according to a modification. The fixing device 20*c* includes the heating roller 201, a housing 210*c*, a heat sensor 220*c*, a connector 230*c*, and wiring lines 221*c* and 222*c*. The housing 210*c* has a hole through which the wiring lines 221*c* and 222*c* run.

The wiring lines 221*c* and 222*c* each have one end thereof connected to the heat sensor 220*c* and the other end thereof connected to the connector 230*c*. The connector 230*c* is not fixed to the housing 210*c*. When the fixing device 20*c* is attached to the body of the image forming apparatus, the connector 230*c* is fitted into the connector provided to the body of the image forming apparatus and is thus fixed. In this case, the connector 230*c* is positioned apart from the housing 210*c*. Hence, the amount of heat transmitted from the heating roller 201 to the electronic component is smaller than in the case where the electronic component is directly fixed to the housing of the fixing device.

Note that the connector 230*c* is positioned in the same manner as with the connector 230 according to the above exemplary embodiment, except that the connector 230*c* is not fixed to the housing 210*c*. Specifically, the connector 230*c* includes a portion that overlaps the passing areas D1 and D2 in terms of the position in the long-side direction A5. Hence, as with the case of the above exemplary embodiment, although the connector 230*c* is positioned on the inner side with respect to the end 201E of the heating roller 201 in the long-side direction A5, the amount of heat transmitted from the heating roller 201 to the connector 230*c* is smaller than in a configuration where the connector 230*c* is provided at a different position.

[2-5] Heat-Insulating Member

A heat-insulating member other than the housing may be provided on the arrow-head side with respect to the heating roller 201 in the second stacking direction A4.

Figure 8A:
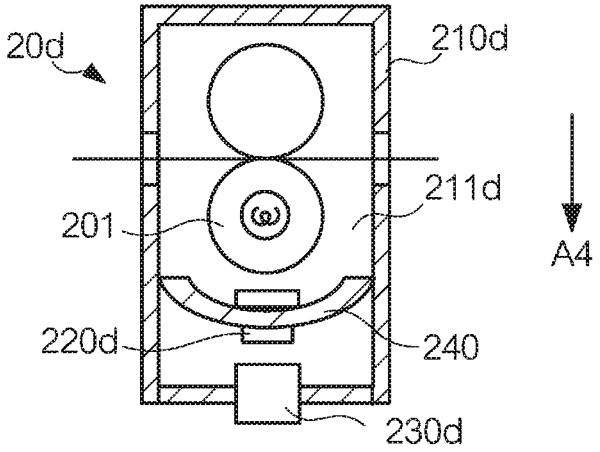
FIGS. 8A and 8B illustrate a fixing device according to another modification.
Figure 8B:
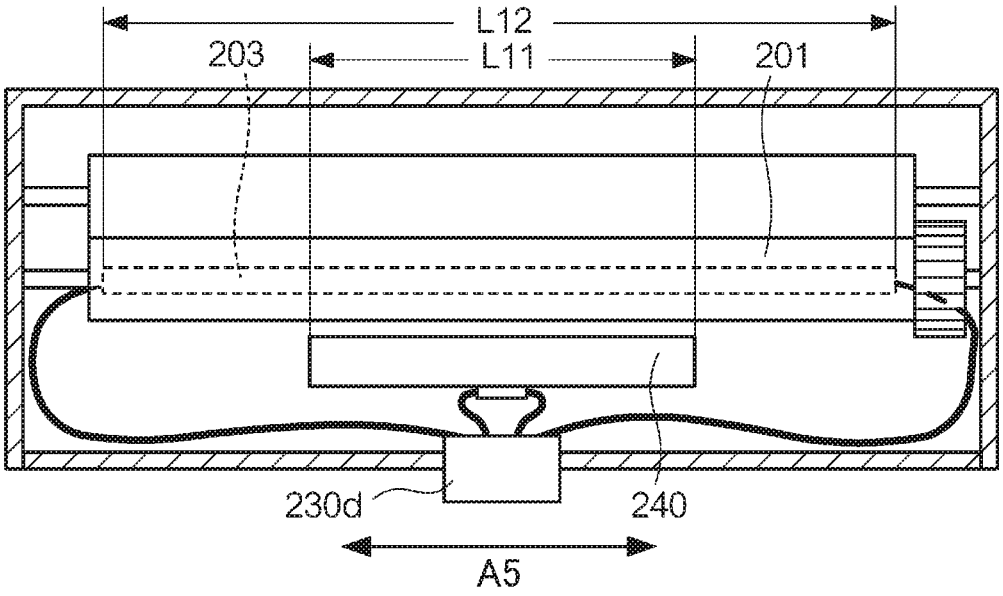

FIGS. 8A and 8B illustrate a fixing device 20*d* according to another modification. The fixing device 20*d* includes the heating roller 201, a housing 210*d*, a heat sensor 220*d*, an electronic component 230*d*, and a reflecting member 240. The reflecting member 240 has a highly reflective member, such as aluminum, provided over the surface thereof, and blocks radiant heat by reflecting far-infrared rays emitted from the heating roller 201. The reflecting member 240 is an example of "heat-insulating member" according to the present invention.

The housing 210*d* has a first housing space 211*d* in which the heating roller 201 is provided. The reflecting member 240 is also provided in the first housing space 211*d*. As illustrated in FIG. 8A, the reflecting member 240 is positioned between the heating roller 201 and the electronic component 230*d*, with the reflecting surface thereof facing toward the heating roller 201. The reflecting member 240 has a hole, in which the heat sensor 220*d* is fitted. The reflecting member 240 and the heat sensor 220*d* are each an example of "other member" according to the present invention.

In this modification, the amount of heat transmission from the heating roller 201 to the electronic component 230*d* is smaller than in a case where the reflecting member 240 is not provided. As illustrated in FIG. 8B, a length L11 of the reflecting member 240 in the long-side direction A5 is shorter than a length L12 of a heat-emitting area (an area where the halogen lamp 203 is present) of the heating roller 201 in the long-side direction A5.

In this modification, the reflecting member 240 is provided for reducing the amount of heat transmission from the heating roller 201 to the electronic component 230*d*. As the distance from the electronic component 230*d* in the long-side direction A5 increases, the effect of reducing the amount of heat transmission by the reflecting member 240 is reduced. Therefore, no reflecting member 240 is provided at any other position where the effect of reducing the amount of heat transmission by the reflecting member 240 is small. Thus, the size of the reflecting member 240 and the cost of providing the reflecting member 240 are made smaller than in a case where the reflecting member 240 is provided at each of other positions where the above effect is small.

[2-6] Position of Electronic Component

The position of the electronic component is not limited to any of those described above.

Figure 9:
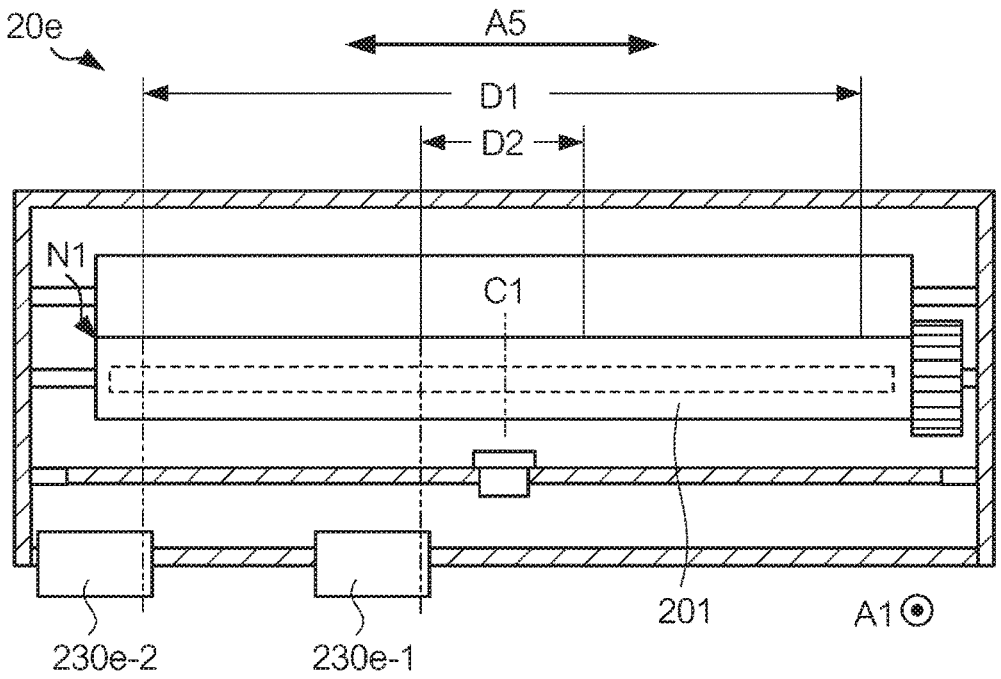
FIG. 9 illustrates a fixing device according to yet another modification that is seen in the transport direction.

FIG. 9 illustrates a fixing device 20*e* according to yet another modification that is seen in the transport direction A1. The fixing device 20*e* includes an electronic component 230*e*-1 and an electronic component 230*e*-2.

The electronic component 230*e*-1 does not include any portion that overlaps the center C1 of the heating roller 201 in terms of the position in the long-side direction A5, unlike the connector 230 according to the above exemplary embodiment, but includes a portion that overlaps the passing area D2 (that is, the smallest ones of the sheets that pass through the nip area N1) in terms of the position in the long-side direction A5. Hence, regardless of the size of the sheet passing through the nip area N1, the amount of heat transmission from the heating roller 201 to the electronic component 230*e*-1 is smaller than in a case where the electronic component 230*e*-1 includes no portion overlapping the passing area D2.

The electronic component 230*e*-2 does not include any portion that overlaps the passing area D2 in terms of the position in the long-side direction A5, but includes a portion that overlaps the passing area D1 (that is, the largest ones of the sheets that pass through the nip area N1) in terms of the position in the long-side direction A5. Hence, when the largest sheet (the sheet having the largest size in the long-side direction A5) passes through the nip area N1, the amount of heat transmission from the heating roller 201 to the electronic component 230*e*-2 is smaller than in a case where the electronic component 230*e*-2 includes no portion overlapping the passing area D1.

Note that a portion of the electronic component 230*e*-2 is positioned on the outer side with respect to the end 201E of the heating roller 201 in the long-side direction A5, but the other portion of the electronic component 230*e*-2 is positioned on the inner side with respect to the end 201E. Hence, the electronic component 230*e*-2 is regarded as being positioned on the inner side with respect to the end 201E. That is, the expression "the electronic component is positioned on the inner side with respect to the end 201E" is not limited to a situation where the entirety of the electronic component is positioned on the inner side with respect to the end 201E and includes a situation where only a portion of the electronic component is positioned on the inner side with respect to the end 201E.

Figure 10:
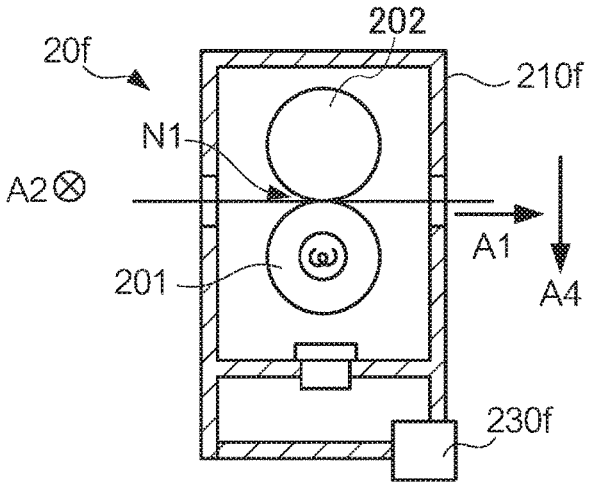
FIG. 10 illustrates a fixing device according to yet another modification that is seen in a rotational-axis direction.

FIG. 10 illustrates a fixing device 20*f* according to yet another modification that is seen in the rotational-axis direction A2. The fixing device 20*f* includes an electronic component 230*f*. The electronic component 230*f* is not provided on a side of the heating roller 201 that is exactly opposite the pressure roller 202, unlike the connector 230 according to the above exemplary embodiment, but is fixed at a position of a housing 210*f* that is shifted in the transport direction A1 with respect to the pressure roller 202. In such a configuration also, regardless of the size of the sheet passing through the nip area N1, the amount of heat transmission from the heating roller 201 to the electronic component 230*f* is smaller, as long as the electronic component 230*f* includes a portion that overlaps, for example, the passing area D2 (that is, the smallest ones of the sheets that pass through the nip area N1) in terms of the position in the long-side direction A5, than in a configuration in which the electronic component 230*f* includes no portion overlapping the passing area D2.

[2-7] Rotatable Member

The rotatable members included in the fixing device according to each of the above exemplary embodiment and the modifications thereof are each a roller, i.e., a cylindrical member. Each of the rotatable members is not limited to such a member and may be a belt, for example, as long as two rotatable members in combination form a nip area therebetween and are capable of applying heat to a sheet passing through the nip area. Moreover, the heat source of the heating roller serving as one of the rotatable member that generates heat is not limited to a halogen lamp described above. The heating roller may be heated by induction heating or any other like scheme.

[2-8] Heating Unit

While the above exemplary embodiment and the modifications thereof each concern a case where the fixing device is an example of "heating unit" according to the present invention, the present invention is not limited to such a case. For example, the heating unit may be a unit included in an apparatus that coats a sheet with a film or the like by heating the film or the like with the unit. That is, the purpose of the heating unit is arbitrary, as long as the unit applies heat to a sheet passing through a nip area.

[2-9] Members Provided Between Electronic Component and First Rotatable Member

While the above exemplary embodiment and the modifications thereof each concern a case where any of the inner wall 213, the heat sensor 220, the reflecting member 240, and the heat sensor 220*c* (which are each an example of "other member" according to the present invention) are provided between the electronic component and the first rotatable member, the present invention is not limited to such a case. For example, two or three inner walls or reflecting members or any other members may be provided between the two. In any case, "other member" may be a member integrated with the housing, such as the inner wall, or a member separate from the housing, such as the reflecting member or the heat sensor.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A heating unit comprising:

a first rotatable member that generates heat;

a second rotatable member that forms, in combination with the first rotatable member, a nip area through which sheets of different sizes pass one by one;

a housing that supports the first and second rotatable members such that the first and second rotatable members are rotatable;

an electronic component that is fixed to the housing and includes a portion that overlaps a smallest one of the sheets passing through the nip area in terms of a position in a long-side direction of the nip area; and an other member that is provided between the first rotatable member and the electronic component, wherein the other member is a heat sensor, a reflecting member, or a heat sensor and a reflecting member.

2. The heating unit according to claim 1, wherein the housing has a ridge, and wherein the electronic component is fixed to the ridge.

3. The heating unit according to claim 2, further comprising a heat-insulating member other than the housing, the heat-insulating member being provided between the electronic component and the first rotatable member, wherein a length of the heat-insulating member in the long-side direction of the nip area is shorter than a length of a heat-generating area of the first rotatable member in the long-side direction of the nip area.

4. The heating unit according to claim 1, further comprising a heat-insulating member other than the housing, the heat-insulating member being provided between the electronic component and the first rotatable member, wherein a length of the heat-insulating member in the long-side direction of the nip area is shorter than a length of a heat-generating area of the first rotatable member in the long-side direction of the nip area.

5. The heating unit according to claim 1, wherein the electronic component is a connector, and wherein the heating unit further includes:

a sensor that faces the first rotatable member and includes a portion overlapping the connector in terms of the position in the long-side direction of the nip area; and a wiring line that connects the connector and the sensor to each other.

6. The heating unit according to claim 1, wherein the electronic component is provided at a position shifted from a position that is vertically above the first rotatable member in a state where the heating unit is attached to a predetermined body.

7. The heating unit according to claim 1, wherein the electronic component includes a portion overlapping a center of the first rotatable member in terms of the position in the long-side direction of the nip area.

8. An image forming apparatus comprising:

the heating unit according to claim 1;

a transport device that transports the sheets one by one along a transport path including the nip area; and an image forming device that forms an image on the transported sheet at a position on an upstream side with respect to the nip area.

9. A heating unit comprising:

a first rotatable member that generates heat;

a second rotatable member that forms, in combination with the first rotatable member, a nip area through which sheets of different sizes pass one by one;

an electronic component that is provided across the first rotatable member from the second rotatable member and includes a portion that overlaps a smallest one of the sheets passing through the nip area in terms of a position in a long-side direction of the nip area; and an other member that is provided between the first rotatable member and the electronic component, wherein the other member is a heat sensor, a reflecting member, or a heat sensor and a reflecting member.

10. The heating unit according to claim 9, further comprising a housing that supports the first and second rotatable members such that the first and second rotatable members are rotatable, wherein the electronic component is positioned apart from the housing.

11. The heating unit according to claim 10, further comprising a heat-insulating member other than the housing, the heat-insulating member being provided between the electronic component and the first rotatable member, wherein a length of the heat-insulating member in the long-side direction of the nip area is shorter than a length of a heat-generating area of the first rotatable member in the long-side direction of the nip area.

12. A heating unit comprising:

a first rotatable member that generates heat;

a second rotatable member that forms, in combination with the first rotatable member, a nip area through which sheets of different sizes pass one by one;

a housing that supports the first and second rotatable members such that the first and second rotatable members are rotatable;

an electronic component that is fixed to the housing and includes a portion that overlaps a smallest one of the sheets passing through the nip area in terms of a position in a long-side direction of the nip area; and an other member that is provided between the first rotatable member and the electronic component, wherein the housing has a ridge and the electronic component is fixed to the ridge.

* * * * *